US012642330B2

(12) United States Patent
Eldem et al.

(10) Patent No.: US 12,642,330 B2
(45) Date of Patent: Jun. 2, 2026

(54) ARTICLE OF FOOTWEAR

(71) Applicant: NIKE, Inc., Beaverton, OR (US)

(72) Inventors: Can Eldem, Portland, OR (US); Lai Wa C. Ho, Beaverton, OR (US); Emily Simmons, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/745,014

(22) Filed: Jun. 17, 2024

(65) Prior Publication Data

US 2024/0335003 A1 Oct. 10, 2024

Related U.S. Application Data

(63) Continuation of application No. 17/673,722, filed on Feb. 16, 2022, now Pat. No. 12,035,778.

(60) Provisional application No. 63/161,401, filed on Mar. 15, 2021.

(51) Int. Cl.
*A43B 13/20* (2006.01)
*A43B 13/12* (2006.01)

(52) U.S. Cl.
CPC ..... *A43B 13/20* (2013.01); *A43B 13/127* (2013.01)

(58) Field of Classification Search
CPC ..... A43B 13/20; A43B 13/206; A43B 13/127; A43B 13/186; A43B 13/125; A43B 13/28; A43B 13/12; A43B 21/28
See application file for complete search history.

(56) References Cited

U.S. PATENT DOCUMENTS

| | | | | |
|---|---|---|---|---|
| 6,944,973 | B2 | 9/2005 | Goodwin | |
| 7,707,745 | B2 | 5/2010 | Schindler et al. | |
| 8,087,187 | B2 | 1/2012 | Aveni et al. | |
| 8,099,880 | B2 * | 1/2012 | Brewer | A43B 13/187 36/35 R |
| 8,635,785 | B2 | 1/2014 | Seo | |
| 9,179,733 | B2 | 11/2015 | Peyton et al. | |
| 2004/0025375 | A1 | 2/2004 | Turner et al. | |
| 2007/0033833 | A1 | 2/2007 | Chang et al. | |

(Continued)

FOREIGN PATENT DOCUMENTS

| | | | |
|---|---|---|---|
| WO | WO-2021101964 | A1 | 5/2021 |
| WO | WO-2021242832 | A1 | 12/2021 |
| WO | WO-2022035738 | A1 | 2/2022 |

OTHER PUBLICATIONS

European Patent Office (ISA), International Search Report and Written Opinion for PCT App. No. PCT/US2022/016846, mailed May 23, 2022.

(Continued)

*Primary Examiner* — Patrick J. Lynch
*Assistant Examiner* — Brianna T. Duckworth
(74) *Attorney, Agent, or Firm* — Honigman LLP; Matthew H. Szalach; Jonathan P. O'Brien

(57) ABSTRACT

An aspect of the disclosure provides a structure for an article of footwear. The sole structure includes a cushioning element having a first material. The sole structure further includes a cradle including a second material, attached to the cushioning element, and including a plate disposed against the cushioning element and a pair of supports extending from opposite ends of the plate. The sole structure also includes a bladder disposed within the cradle between the supports. An upper barrier layer of the bladder contacts the plate.

18 Claims, 14 Drawing Sheets

(56) References Cited

U.S. PATENT DOCUMENTS

| | | | | |
|---|---|---|---|---|
| 2008/0034615 | A1 | 2/2008 | Nishiwaki et al. | |
| 2009/0019729 | A1 | 1/2009 | Nakano et al. | |
| 2009/0151196 | A1* | 6/2009 | Schindler | A43B 13/20 36/35 B |
| 2009/0241376 | A1* | 10/2009 | Robson | A43B 13/186 36/35 B |
| 2012/0174432 | A1 | 7/2012 | Peyton | |
| 2019/0289959 | A1 | 9/2019 | Matsui et al. | |
| 2020/0022455 | A1* | 1/2020 | Eldem | A43B 7/1415 |
| 2020/0305551 | A1* | 10/2020 | Campos, II | A43B 13/127 |

OTHER PUBLICATIONS

USPTO, Notice of Allowance and Fees due for U.S. Appl. No. 17/673,722, mailed Mar. 13, 2024.
USPTO, Final Office Action for U.S. Appl. No. 17/673,722, mailed Dec. 11, 2023.
USPTO, Non-Final Office Action for U.S. Appl. No. 17/673,722, mailed Jul. 14, 2023.

* cited by examiner

ARTICLE OF FOOTWEAR

CROSS REFERENCE TO RELATED APPLICATIONS

This application is a continuation of U.S. patent application Ser. No. 17/673,722, filed Feb. 16, 2022, which claims priority under 35 U.S.C. § 119 (e) to U.S. Provisional Application No. 63/161,401, filed on Mar. 15, 2021. The disclosure of these prior applications are considered part of the disclosure of this application and are hereby incorporated by reference in their entirety.

FIELD

The present disclosure relates generally to an article of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may incorporate a fluid-filled bladder to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
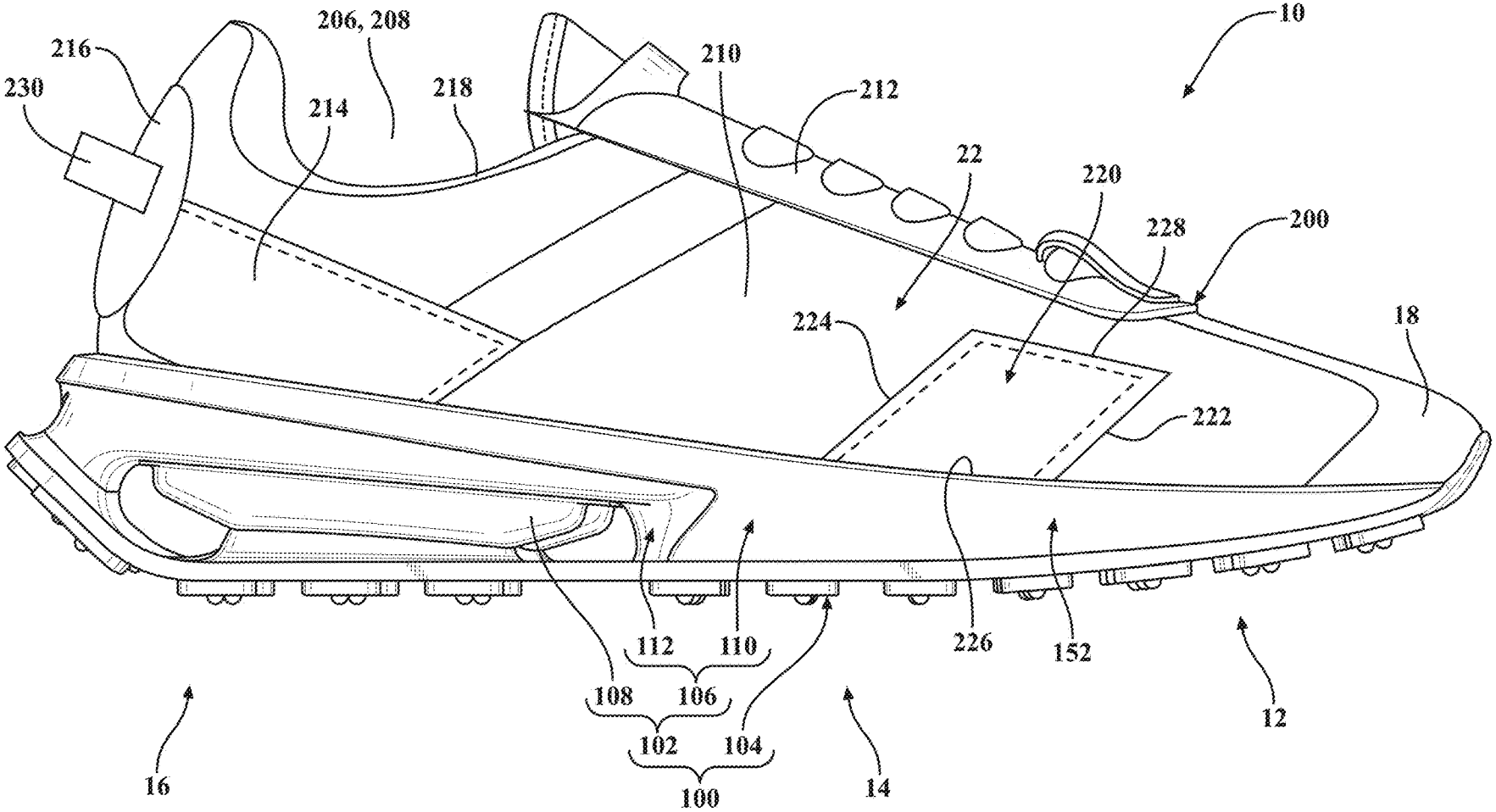
FIG. 1 is a perspective view of an article of footwear including a sole structure and upper according to the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

An aspect of the disclosure provides a structure for an article of footwear. The sole structure includes a cushioning element including a first material. The sole structure further includes a cradle including a second material, attached to the cushioning element, and including a plate disposed against the cushioning element and a pair of supports extending from opposite ends of the plate. The sole structure also includes a bladder disposed within the cradle between the supports, wherein an upper barrier layer of the bladder contacts the plate.

This aspect of the disclosure may include one or more of the following optional features. In one configuration, the sole structure includes an outsole disposed adjacent to the plate on an opposite side of the cradle from the cushioning element. In one implementation, a lower barrier layer of the bladder contacts the outsole. In one example, each of the supports contacts the outsole.

In another configuration, the plate and supports partially define a receptacle extending continuously through the cradle from a first side to a second side. Here, each of the supports includes a concave surface facing the bladder. Optionally, the concave surface of each of the supports is spaced apart from the bladder.

In some examples, the bladder contacts the cushioning element through the cradle. In such an example, the cradle includes an opening. The cushioning element includes an upper dock engaging the bladder through the opening of the cradle. In one aspect, the upper dock may include a plurality of ribs extending through a plurality of openings of the cradle to engage bladder. In some configurations, the plate has a greater hardness than the cushioning element.

Another aspect of the disclosure provides a sole structure for an article of footwear. The sole structure includes a cushioning element, a cradle and a bladder. The cradle is received by the cushioning element and defines a receptacle extending continuously through the cradle from a first side of the sole structure to a second side of the sole structure. The bladder is disposed within the receptacle and contacts the cradle. A portion of the bladder contacts the cushioning element.

This aspect of the disclosure may include one or more of the following optional features. In one example, the sole structure includes an outsole disposed on an opposite side of the cradle from the cushioning element. Optionally, a lower barrier layer of the bladder contacts the outsole.

In some examples, the cradle includes a plate contacting an upper barrier layer of the bladder. Here, the cradle may include a first end support extending from the plate at a first end of the cradle and a second end support extending from the plate at a second end of the cradle.

In some examples, the cushioning element includes an upper dock engaging the bladder through the cradle. In such an example, the plate includes at least one opening formed therethrough and a portion of the cushioning element extends through the at least one opening so as to engage the bladder.

In some implementations, the cushioning element includes an upper dock engaging the bladder through an opening in the cradle. In some examples, the upper dock includes a plurality of ribs and the cradle includes a plurality of openings, wherein the plurality of ribs extend through a corresponding one of the plurality of openings in the cradle to engage bladder. In some configurations, the cradle has a greater hardness than the cushioning element. Optionally, the cradle has a hardness of 85 Shore A and the cushioning element has a hardness of 39 to 45 Shore C.

Another aspect of the disclosure provides an article of footwear including a sole structure and an upper attached to the sole structure and including at least one tessellation panel configured to define a tessellation zone along the upper. This aspect of the disclosure may include one or more of the following optional features. In some examples, the tessellation panel is aligned with a support member of the sole structure. In other implementations, the tessellation panel includes a first edge aligned with an end of the support member of the sole structure in a mid-foot region.

Figure 4:
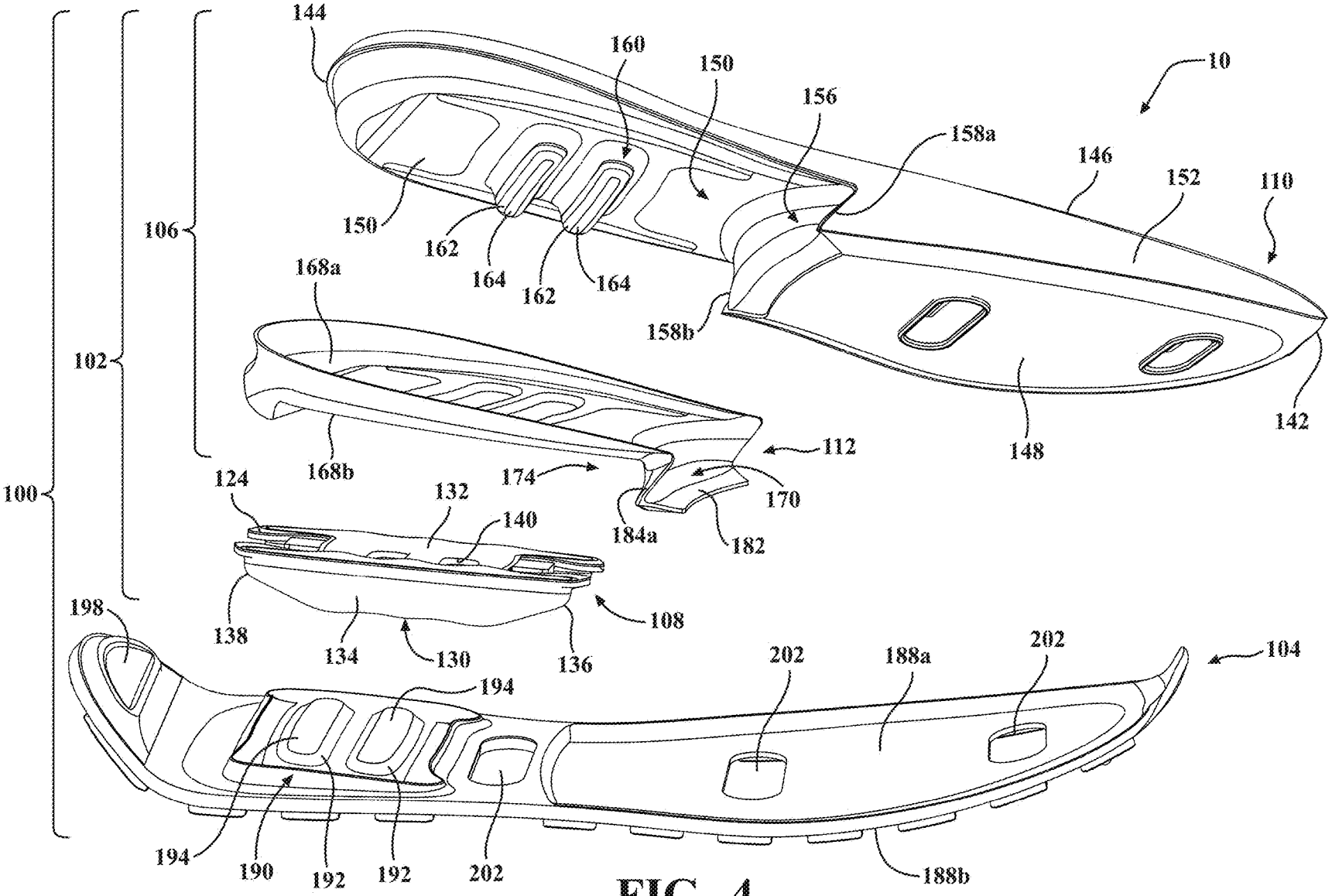
FIG. 4 is an exploded, bottom perspective view of the sole structure of FIG. 1 taken from the medial side.
Figure 5:
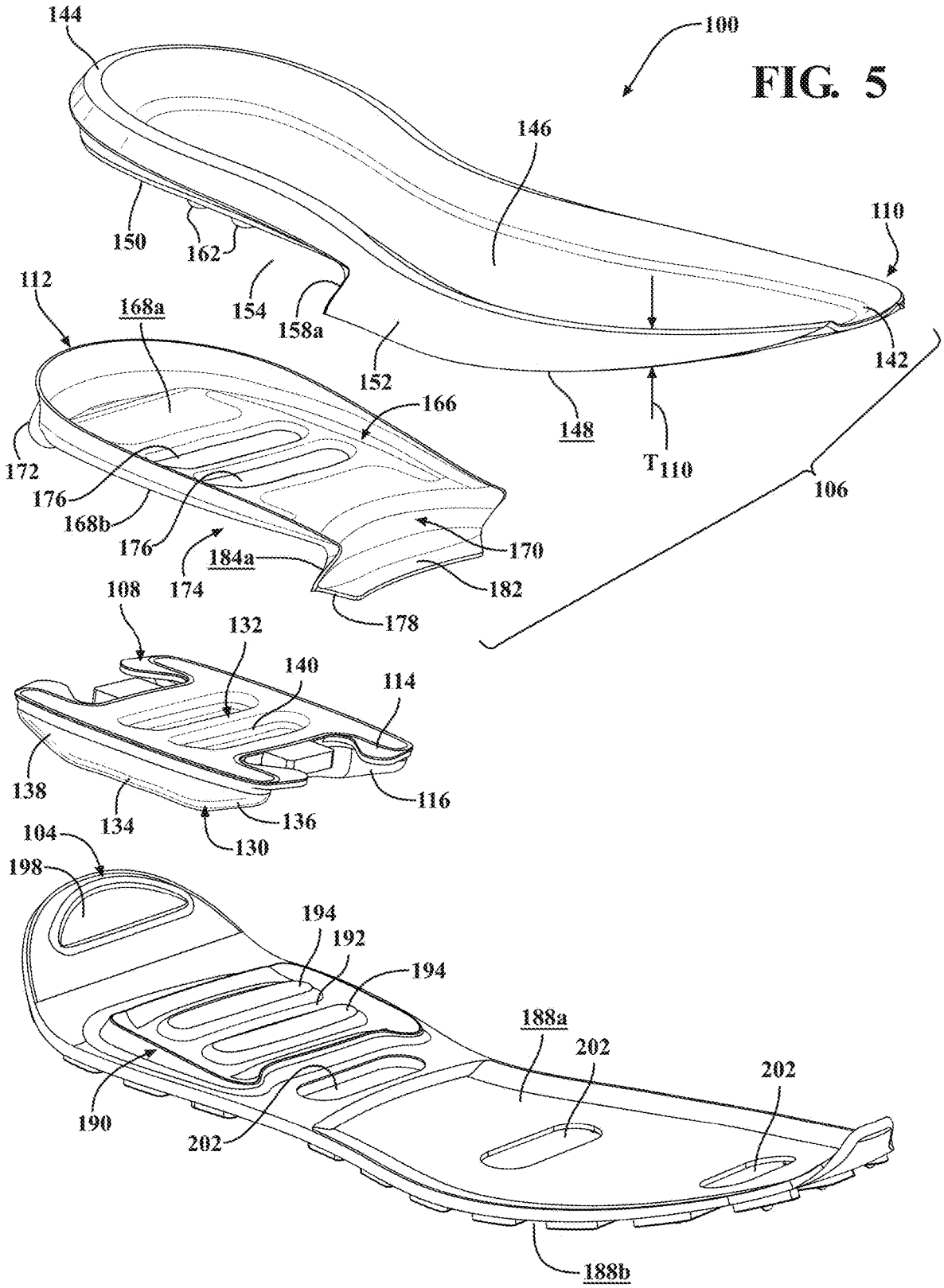
FIG. 5 is an exploded, top perspective view of the sole structure of FIG. 1 taken from the lateral side.

Referring to FIGS. 1-19, an article of footwear 10 is provided, which includes a sole structure 100 and an upper 200 attached to the sole structure 100. The article of footwear 10 may be divided into one or more regions. The regions may include a forefoot region 12, a mid-foot region 14, and a heel region 16. The forefoot region 12 corresponds to the phalanges and the metatarsophalangeal joint (i.e., "the ball") of the foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a lateral side 22 and a medial side 24, as shown in FIG. 5. Accordingly, the lateral side 22 and the medial side 24 respectively correspond with opposite sides of the footwear 10 and extend through the regions 12, 14, 16.

With reference to FIGS. 1-6, the sole structure 100 includes a midsole 102 configured to provide cushioning characteristics to the sole structure 100, and an outsole 104 configured to provide a ground-engaging surface of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 may be described as including a bladder 108 and a chassis 106, where the chassis 106 is configured to be attached to the upper 200 and provides an interface between the upper 200, the bladder 108, and the outsole 104.

Figure 17:
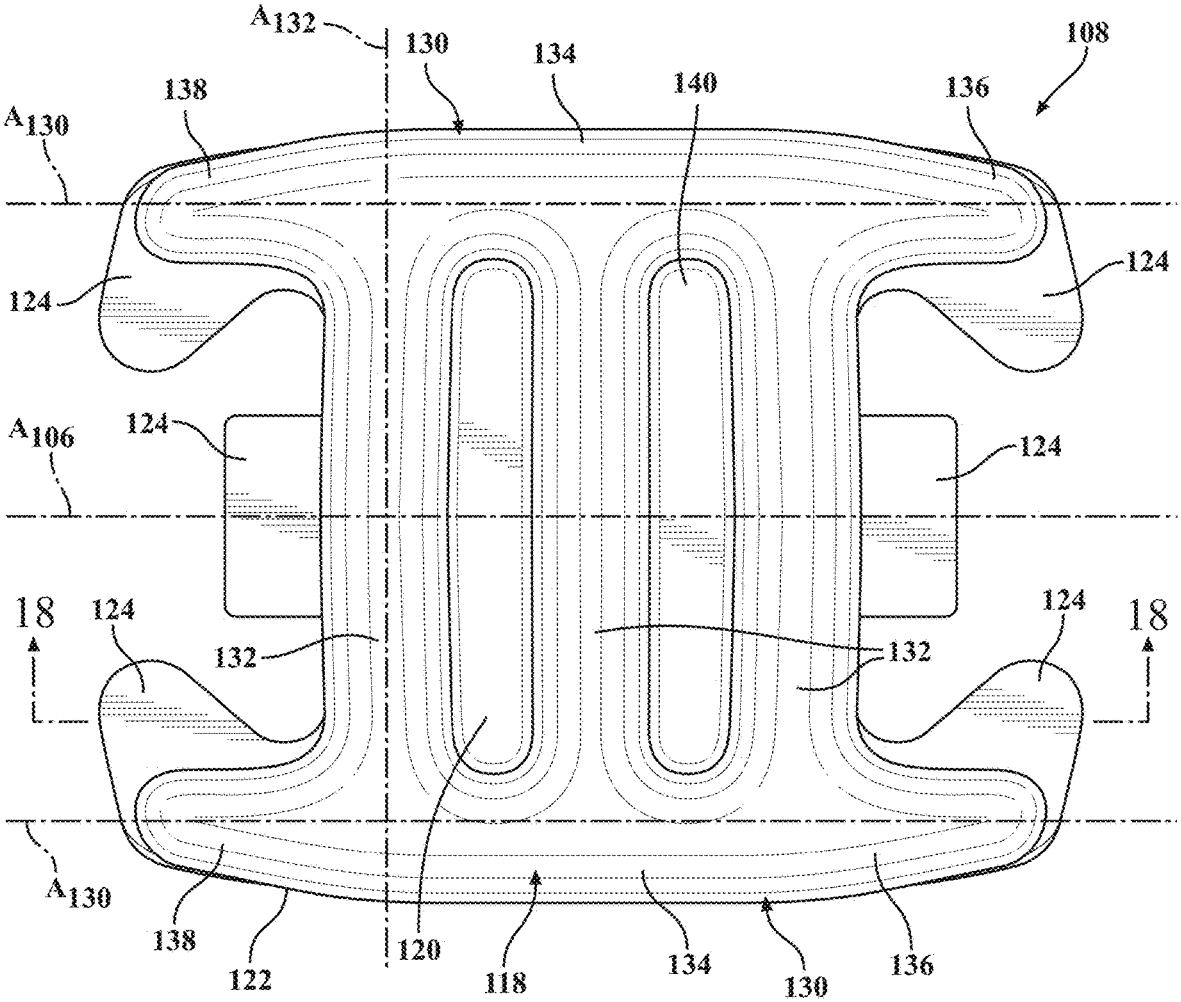
FIG. 17 is a top plan view of a bladder of the sole structure of FIG. 1.
Figure 18:
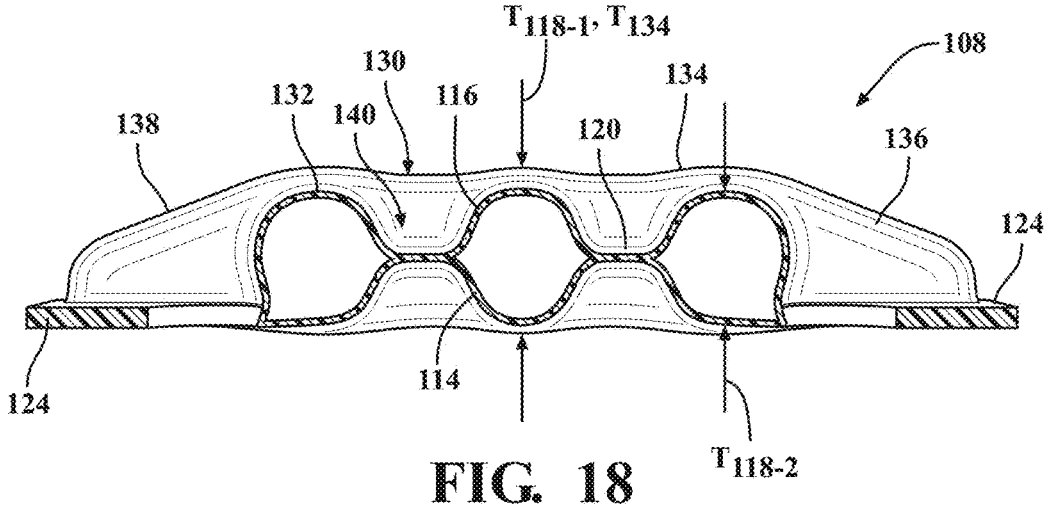
FIG. 18 is a cross-sectional view of the bladder shown in FIG. 17 taken along Line 18-18.

Generally, the bladder 108 of the sole structure 100 is supported within the heel region 16 of the chassis 106 and is configured to attenuate forces associated with impacts in the heel region 16. Referring to FIGS. 17 and 18, the bladder 108 of the midsole 102 includes an opposing pair of barrier layers 114, 116, which are joined to each other at discrete locations to define a chamber 118, a web area 120, and a peripheral seam 122. In the illustrated embodiment, the barrier layers 114, 116 include a first, upper barrier layer 114 and a second, lower barrier layer 116. Alternatively, the chamber 118 can be produced from any suitable combination of one or more barrier layers, as described in greater detail below.

In some implementations, the upper barrier layer 114 and the lower barrier layer 116 cooperate to define a geometry (e.g., thickness, width, and length) of the chamber 118. For example, the web area 120 and the peripheral scam 122 may cooperate to bound and extend around the chamber 118 to seal the fluid (e.g., air) within the chamber 118. Thus, the chamber 118 is associated with an area of the bladder 108 where interior surfaces of the upper and lower barrier layers 114, 116 are not joined together and, thus, are separated from one another.

Figure 11:
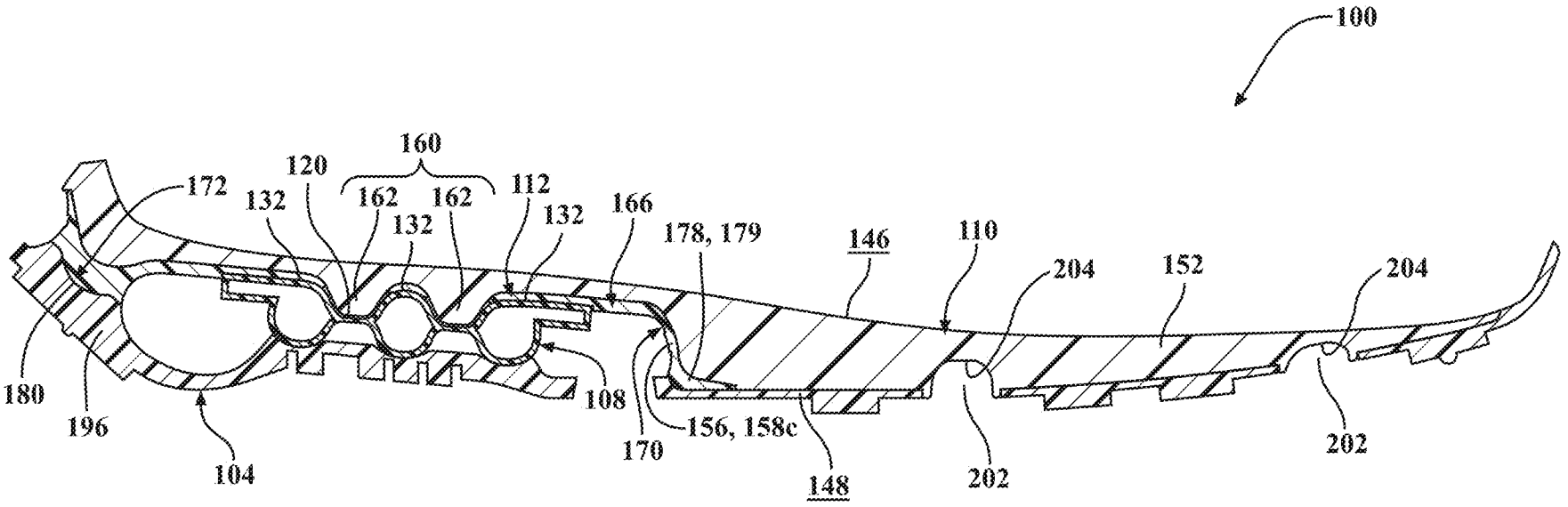
FIG. 11 is a cross-sectional view of the sole structure of FIG. 9, taken along Line 11-11.
Figure 12:
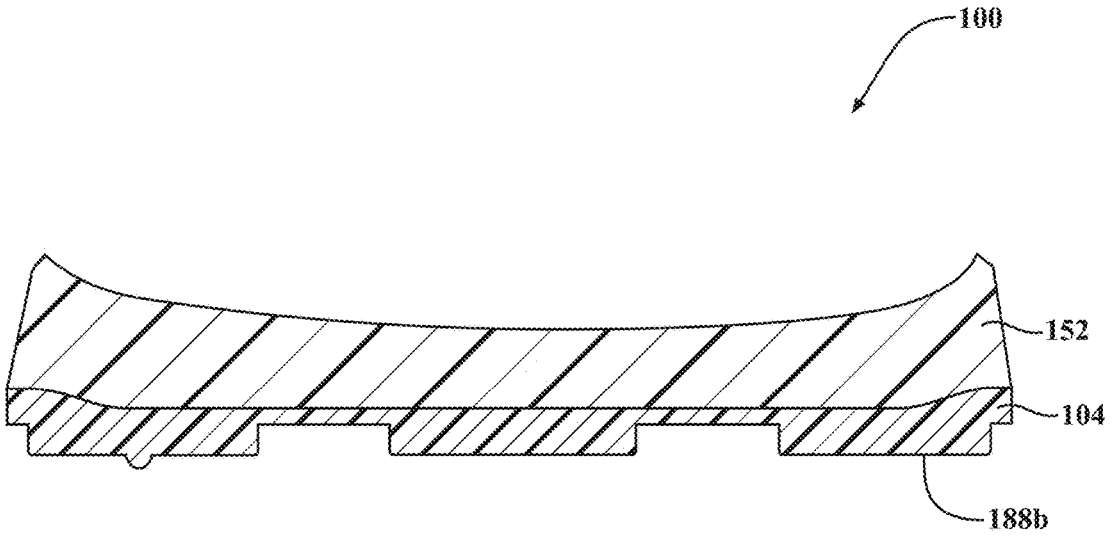
FIG. 12 is a cross-sectional view of the sole structure of FIG. 9, taken along Line 12-12.
Figure 13:
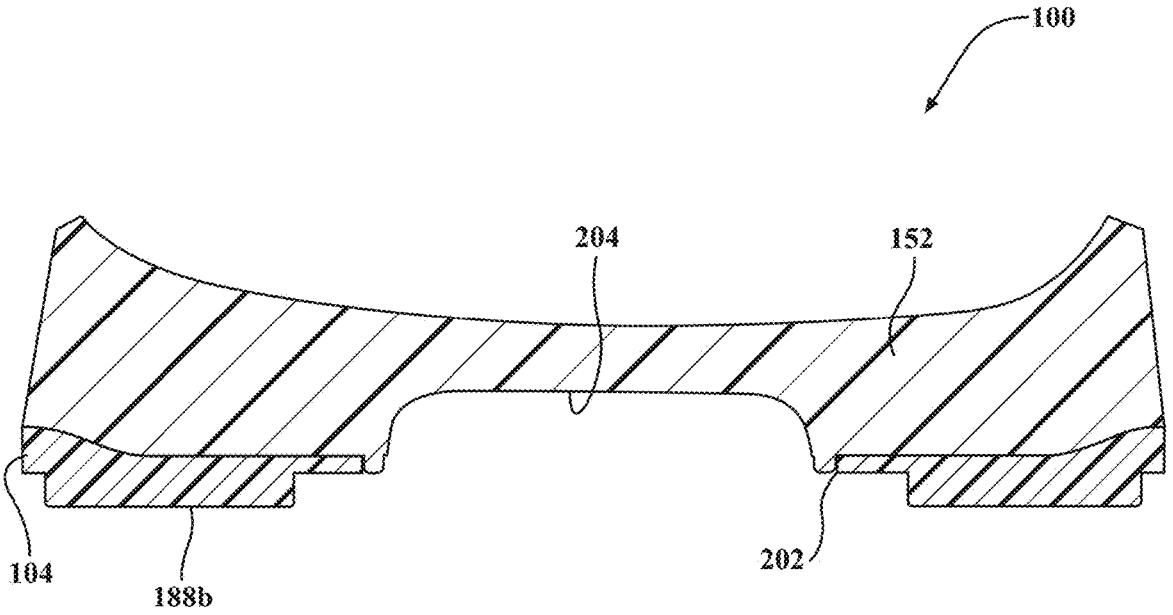
FIG. 13 is a cross-sectional view of the sole structure of FIG. 9, taken along Line 13-13.
Figure 14:
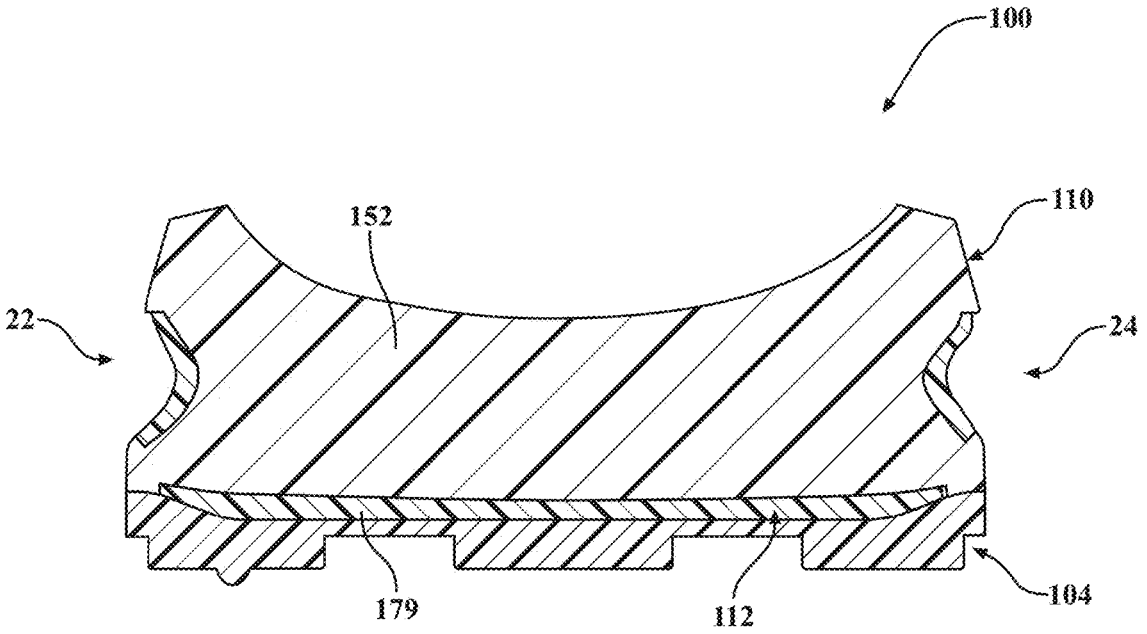
FIG. 14 is a cross-sectional view of the sole structure of FIG. 9, taken along Line 14-14.
Figure 15:
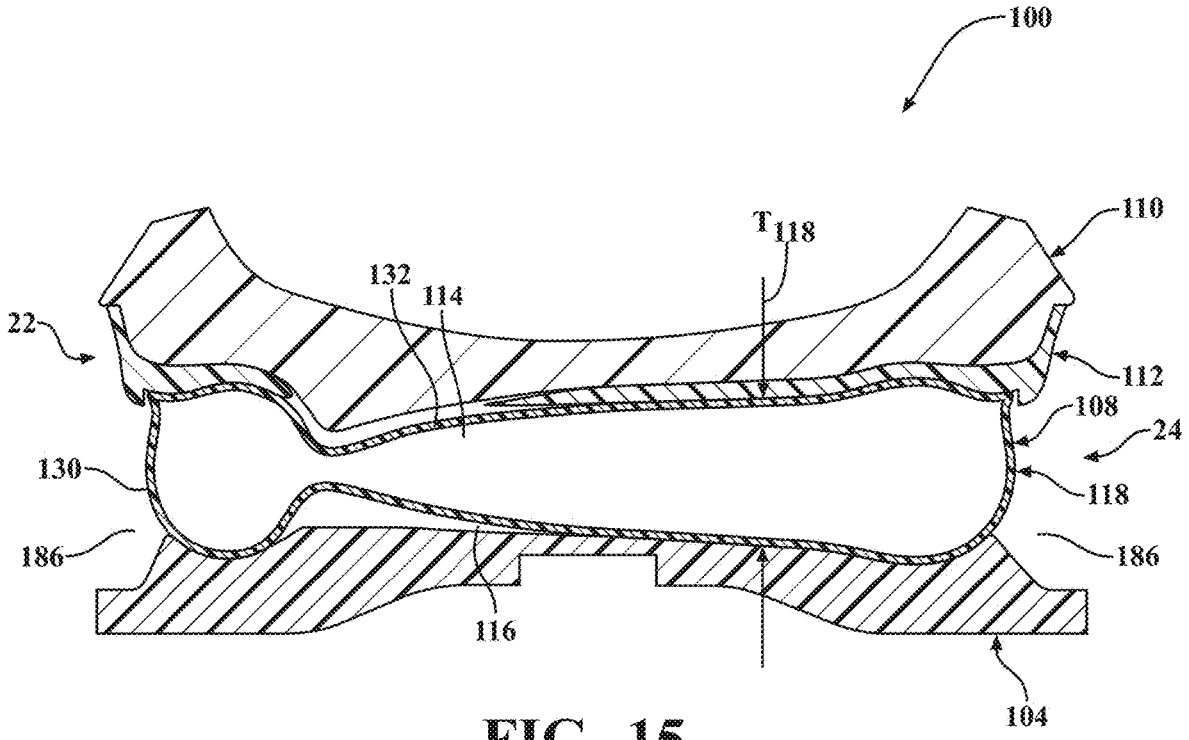
FIG. 15 is a cross-sectional view of the sole structure of FIG. 9, taken along Line 15-15.

As shown in FIGS. 11 and 15, a space formed between opposing interior surfaces of the upper and lower barrier layers 114, 116 defines an interior void of the chamber 118. Similarly, exterior surfaces of the upper and lower barrier layers 114, 116 define an exterior profile of the chamber 118. Thicknesses Tus of the chamber 118 are defined by the distance between the upper and lower barrier layers 114, 116 of the bladder 108.

As best shown in FIG. 17, the chamber 118 includes a plurality of segments 130, 132 that cooperate to provide characteristics of responsiveness and support to the midsole 102. Particularly, the segments 130, 132 may be described as including a pair of cushions 130 on opposite sides of the bladder 108, which are connected (i.e., in fluid communication) with each other by one or more conduits 132. When assembled to in the sole structure 100, the cushions 130 of the chamber 118 are configured to be at least partially exposed along a peripheral edge of the sole structure 100.

Referring still to FIG. 17 and now to FIG. 18, each of the cushions 130 includes a tubular body 134 extending between a first terminal end 136 and a second terminal end 138. The tubular body 134 defines a substantially circular cross section that extends along a longitudinal axis $A_{130}$ of the cushion 130. As shown, the thickness $T_{134}$ of the tubular body 134 is substantially constant along the longitudinal axis $A_{130}$ from the first terminal end 136 to the second terminal end 138. Here, the thickness $T_{134}$ of the tubular body 134 defines a first thickness $T_{118\text{-}1}$ of the chamber 118.

As shown in FIG. 5, the first terminal end 136 and the second terminal end 138 of each cushion 130 are tapered in opposite directions extending away from the tubular body 134 along the longitudinal axis $A_{130}$ of each cushion 130. For example, the first terminal end 136 of each cushion 130 is formed where an end portion of the lower barrier layer 116 converges with and is joined to the upper barrier layer 114 at the peripheral seam 122 to enclose an anterior end of the tubular body 134. As shown, a portion of the first terminal end 136 formed by the upper barrier layer 114 is substantially flat (i.e., continuous with the tubular body 134), while a portion of the first terminal end 136 formed by the lower barrier layer 116 tapers or converges towards the upper barrier layer 114. Referring still to FIG. 5, the second terminal end 138 of each cushion 130 is formed where another end portion of the lower barrier layer 116 converges with and is joined to the upper barrier layer 114 at the peripheral seam 122 to enclose the opposite end of the tubular body 134. As shown, a portion of the second terminal end 138 formed by the upper barrier layer 114 is substantially flat (i.e., continuous with the tubular body 134), while a portion of the second terminal end 138 formed by the lower barrier layer 116 tapers or converges towards the upper barrier layer 114.

As provided above, each of the cushions 130 defines a respective longitudinal axis $A_{130}$ that extends from the first terminal end 136 to the second terminal end 138. As best shown in FIG. 5, the cushions 130 are spaced apart from each other along a direction transverse to the longitudinal axes $A_{106}$ of the bladder 108. Accordingly, when the bladder 108 is assembled within the sole structure 100, the cushions 130 are spaced apart from each other along a lateral direction of the article of footwear 10 such that a first one of the cushions 130 extends along the lateral side 22 and a second one of the cushions 130 extends along the medial side 24. Furthermore, the longitudinal axes $A_{130}$ of the cushions 130 are parallel with each other and with the longitudinal axis $A_{10}$ of the article of footwear 10 along the direction from the posterior end 20 to the anterior end 18.

With reference to FIGS. 17 and 18, the chamber 118 further includes at least one conduit 132 extending between and fluidly coupling the cushions 130. In the illustrated example, the chamber 118 includes a plurality of the conduits 132 connecting the tubular bodies 134 of the cushions 130 to each other. The conduits 132 each extend along respective longitudinal axes $A_{132}$ that are transverse to the longitudinal axes $A_{130}$ of the cushions 130. As best shown in FIGS. 17 and 18, the conduits 132 include a first conduit 132 extending between the tubular bodies 134 of the cushions 130 adjacent to the first terminal ends 136, a second conduit 132 extending between the tubular bodies 134 of the cushions 130 adjacent to the second terminal ends 138, and a third conduit 132 disposed between the first conduit 132 and the second conduit 132 and connecting intermediate portions of the tubular bodies 134. Accordingly, the first conduit 132 and the second conduit 132 are disposed on opposite sides of the third conduit 132.

As best shown in FIGS. 11 and 18, the conduits 132 are defined by the cooperation of the upper barrier layer 114 and the lower barrier layer 116. As shown in FIG. 18, the upper barrier layer 114 and the lower barrier layer 116 are formed to provide a plurality of cylindrically-shaped conduits 132, each having a substantially similar second thickness $T_{118\text{-}2}$ that is less than the thickness $T_{118\text{-}1}$ of the cushions 130. A profile of each of the conduits 132 is substantially defined by the upper barrier layer 114 and the lower barrier layer 116, whereby the upper barrier layer 114 and the lower barrier layer 116 are molded to define arcuate upper and lower portions of each conduit 132. Although the lower barrier layer 116 is initially provided in a substantially flat state, the lower barrier layer 116 may bulge from the web area 120 when the chamber 118 is pressurized and the lower barrier layer 116 is biased apart from the upper barrier layer 114, as illustrated in FIG. 18.

With reference to FIGS. 11 and 17, the web area 120 is formed at a bonded region of the upper barrier layer 114 and the lower barrier layer 116, and extends between and connects each of the segments 130, 132 of the chamber 118. Intermediate portions of the web area 120 extend between and connect adjacent ones of the conduits 132 and the cushions 130. Accordingly, the intermediate portions of the web area 120 may be completely surrounded by the chamber 118. In the illustrated example, the web area 120 is disposed vertically intermediate with respect to the overall thickness Tus of the fluid-filled chamber 118. Optionally, the upper and lower barrier layers 114, 116 may be joined together to form a plurality of flanges 124 protruding from the peripheral seams 122 at the terminal ends 136, 138 of the cushions 130 and the conduits 132. The flanges 124 may be used as attachment points for further securing the bladder 108 to the chassis 106.

In the illustrated example, the web area 120 and the cushions 130 of the chamber 118 cooperate to define an upper pocket 140 on a first side of the bladder 108 associated with the upper barrier layer 114. Here, the conduits 132 may be disposed within the upper pocket 140 to form an alternating series of bulges and recesses along a length of the upper pocket 140. As described in greater detail below, the chassis 106 may include one or more features configured to mate with the upper pocket 140 when the sole structure 100 is assembled. For instance, the chassis 106 may include indentations and protrusions configured to engage the bulges and recesses formed by the conduits 132 of the bladder 108.

As used herein, the term "barrier layer" (e.g., barrier layers 114, 116) encompasses both monolayer and multilayer films. In some embodiments, one or both of barrier layers 114, 116 are each produced (e.g., thermoformed or blow molded) from a monolayer film (a single layer). In other embodiments, one or both of barrier layers 114, 116 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of barrier layers 114, 116 can independently be transparent, translucent, and/or opaque. For example, the upper barrier layer 114 may be transparent, while the lower barrier layer 116 is opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

Barrier layers 114, 116 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 114, 116 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 114, 116 include two or more sublayers, examples of suitable multilayer films include microlayer films, such as those disclosed in Bonk et al., U.S. Pat. No. 6,582,786, which is incorporated by reference in its entirety. In further embodiments, barrier layers 114, 116 may each independently include alternating sublayers of one or more TPU copolymer materials and one or more EVOH copolymer materials, where the total number of sublayers in each of barrier layers 114, 116 includes at least four (4) sublayers, at least ten (10) sublayers, at least twenty (20) sublayers, at least forty (40) sublayers, and/or at least sixty (60) sublayers.

The chamber 118 can be produced from the barrier layers 114, 116 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, barrier layers 114, 116 can be produced by co-extrusion followed by vacuum thermoforming to produce an inflatable chamber 118, which can optionally include one or more valves (e.g., one way valves) that allows the chamber 118 to be filled with the fluid (e.g., gas).

The chamber 118 can be provided in a fluid-filled (e.g., as provided in footwear 10) or in an unfilled state. The chamber 118 can be filled to include any suitable fluid, such as a gas or liquid. In an aspect, the gas can include air, nitrogen ($N_2$), or any other suitable gas. In other aspects, the chamber 118 can alternatively include other media, such as pellets, beads, ground recycled material, and the like (e.g., foamed beads and/or rubber beads). The fluid provided to the chamber 118 can result in the chamber 118 being pressurized. In some examples, the pressure ranges from 0 psi to 35 psi, and more particularly from 15 psi to 30 psi, and even more particularly from 20 psi to 25 psi. Alternatively, the fluid provided to the chamber 118 can be at atmospheric pressure such that the chamber 118 is not pressurized but, rather, simply contains a volume of fluid at atmospheric pressure.

The chamber 118 desirably has a low gas transmission rate to preserve its retained gas pressure. In some embodiments, the chamber 118 has a gas transmission rate for nitrogen gas that is at least about ten (10) times lower than a nitrogen gas transmission rate for a butyl rubber layer of substantially the same dimensions. In an aspect, the chamber 118 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 114, 116). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the upper and lower barrier layers 114, 116 are formed by respective mold portions each defining various surfaces for forming depressions and pinched surfaces corresponding to locations where the web area 120 and/or the peripheral seam 122 are formed when the upper barrier layer 114 and the lower barrier layer 116 are joined and bonded together. In some implementations, adhesive bonding joins the upper barrier layer 114 and the lower barrier layer 116 to form the web area 120 and the peripheral seam 122. In other implementations, the upper barrier layer 114 and the lower barrier layer 116 are joined to form the web area 120 and the peripheral seam 122 by thermal bonding. In some examples, one or both of the barrier layers 114, 116 are heated to a temperature that facilitates shaping and melding. In some examples, the barrier layers 114, 116 are heated prior to being located between their respective molds. In other examples, the mold may be heated to raise the temperature of the barrier layers 114, 116. In some implementations, a molding process used to form the fluid-filled chamber 118 incorporates vacuum ports within mold portions to remove air such that the upper and lower barrier layers 114, 116 are drawn into contact with respective mold portions. In other implementations, fluids such as air may be injected into areas between the upper and lower barrier layers 114, 116 such that pressure increases cause the barrier layers 114, 116 to engage with surfaces of their respective mold portions.

In the illustrated example, the chassis 106 extends continuously from the anterior end 18 to the posterior end 20, and is configured to receive and support the bladder 108 therein. As shown, the chassis 106 is formed as a composite structure including a cushioning element 110 and a cradle 112 received at least partially within the cushioning element 110. As discussed below, the cradle 112 is configured to receive and support the bladder 108 within the heel region 16 of the cushioning element 110.

Figure 6:
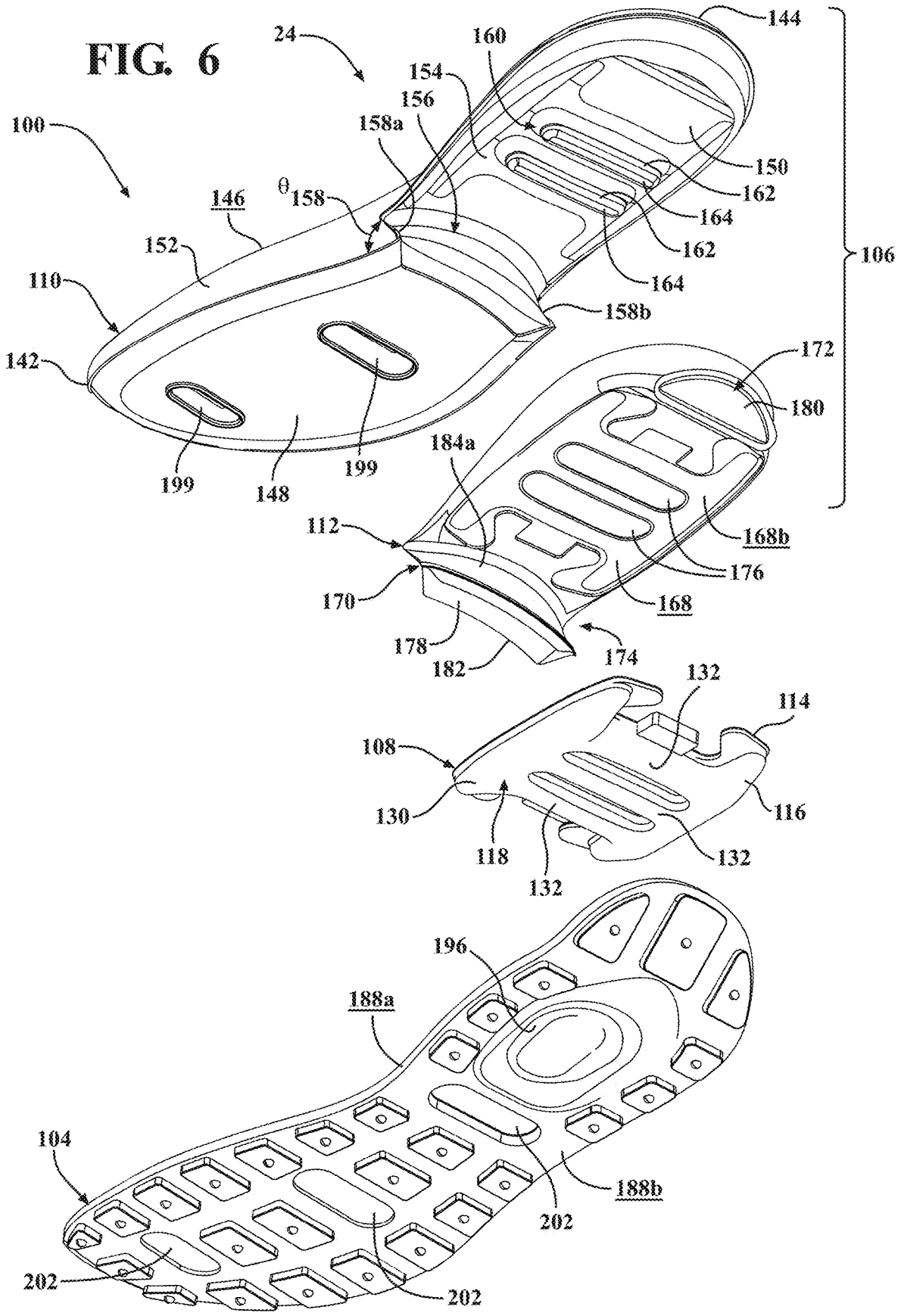
FIG. 6 is an exploded, bottom perspective view of the sole structure of FIG. 1 taken from the medial side.
Figure 7:
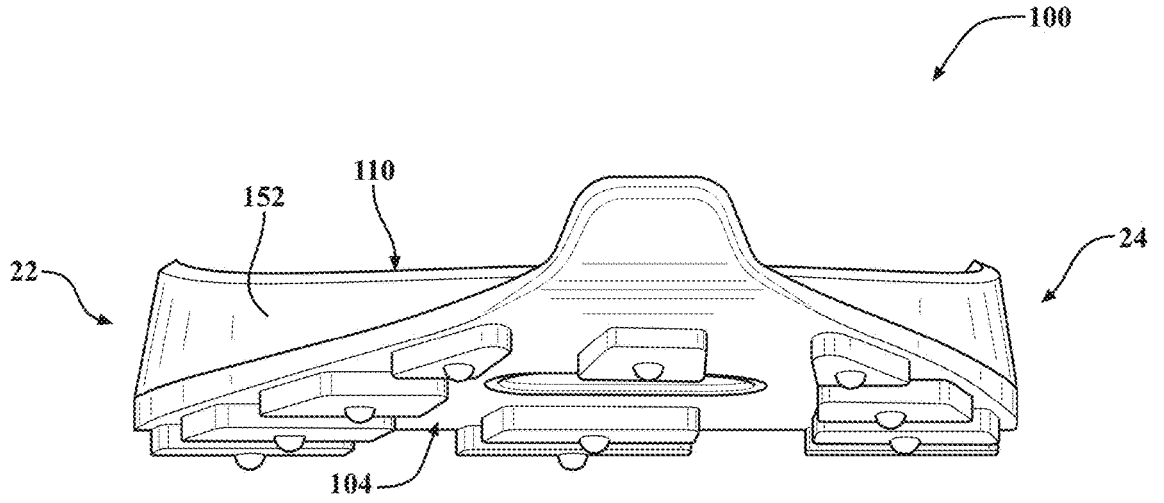
FIG. 7 is a front plan view of the sole structure of FIG. 1.
Figure 8:
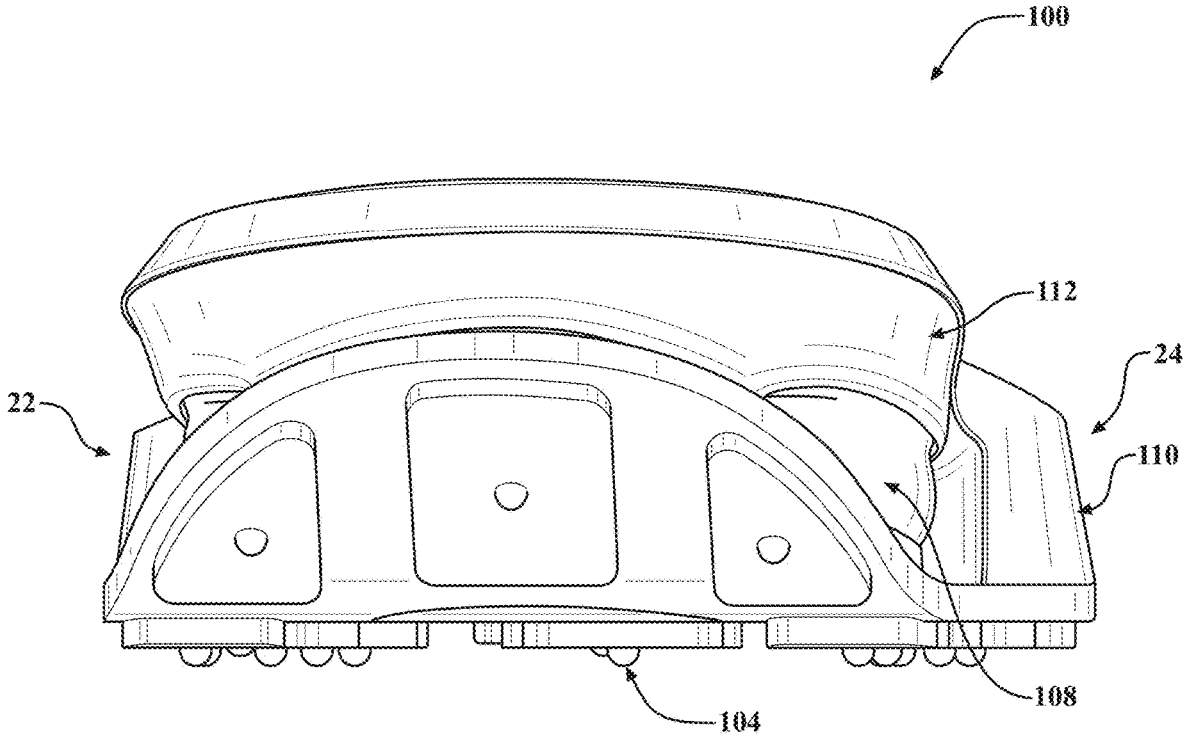
FIG. 8 is a rear plan view of the sole structure of FIG. 1.
Figure 9:
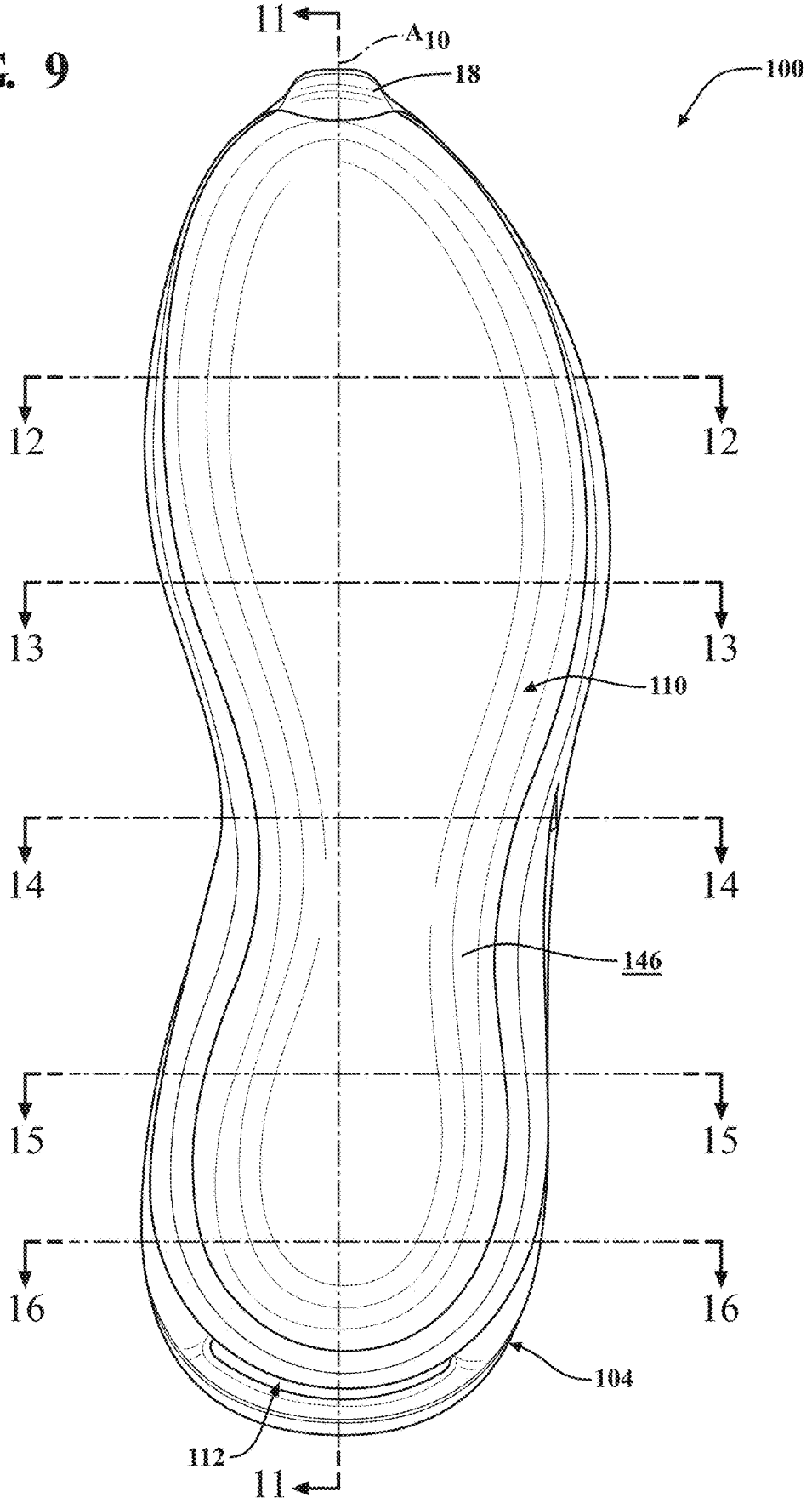
FIG. 9 is a top plan view of the sole structure of FIG. 1.

The cushioning element 110 includes a first material, and extends continuously from a first end 142 at the anterior end 18 of the sole structure 100 to a second end 144 at the posterior end 20 of the sole structure 100. The cushioning element 110 includes a top surface 146 extending continuously from the first end 142 to the second end 144, which defines a footbed of the chassis 106. The cushioning element 110 further includes a bottom surface 148 formed on an opposite side of the cushioning element 110 from the top surface 146. A distance from the top surface 146 to the bottom surface 148 defines an overall thickness $T_{110}$ (FIG. 5) of the cushioning element 110. As best shown in FIGS. 4, 5 and 6, the cushioning element 110 further includes a recessed surface 150 offset from the bottom surface 148 towards the top surface 146.

As shown, the aforementioned surfaces 146, 148, 150 of the cushioning element 110 cooperate to define a support member 152 in the forefoot region 12 and a recess 154 in the heel region 16. The support member 152 of the cushioning element 110 is formed between the top surface 146 and the bottom surface 148, and extends continuously from the first end 142 of the cushioning element 110 to an end wall 156 in the mid-foot region 14. Accordingly, the support member 152 provides cushioning and support characteristics of the chassis 106 in the forefoot region, beneath the phalanges and the ball of the foot. The end wall 156 extends continuously across the entire width of the cushioning element 110 from a first end 158*a* on the lateral side 22 to a second end 158*b* on the medial side 24. As shown, the end wall 156 extends along an arcuate path from the first end 158*a* to the second end 158*b* to define a convex curvature relative to a vertical axis (i.e., perpendicular to the longitudinal and lateral axes) of the sole structure 100.

A cross-sectional profile of the end wall 156 varies along the width of the sole structure 100 to provide different compression characteristics at the ends 158*a*, 158*b* of the end wall 156 than in an intermediate portion of the end wall 156. For example, the end wall 156 may be substantially straight at each of the first end 158*a* and the second end 158, whereby each end 158*a*, 158*b* is formed at an oblique angle $\Theta_{158}$ relative to the bottom surface 148. For example, each end 158*a*, 158*b* extends in a direction oriented from the top surface 146 to the bottom surface 148 and from the first end 142 to the second end 144 of the cushioning element 110. The cross-sectional shape of the end wall 156 gradually transitions from each of the straight ends 158*a*, 158*b* to a concave intermediate portion 158*c* (FIG. 11). The concave intermediate portion 158*c* may be tuned to alter cushioning properties of the support member 152. Additionally, the concave intermediate portion 158*c* may function as a socket to receive and secure a portion of the cradle 112 at the end wall 156.

With continued reference to FIGS. 4, 5 and 6, the recess 154 is defined, in part, by the recessed surface 150. In the illustrated example, the recess 154 is defined at the anterior end by the end wall 156 in the mid-foot region 14. Accordingly, the recess 154 extends from the mid-foot region 14 through the posterior end 20. A depth of the recess 154, defined by the offset distance from the bottom surface 148 to the recessed surface 150, corresponds to a height of the cradle 112. When the cradle 112 is received within the recess 154, the bottom portion of the cradle 112 is flush with the bottom surface 148 of the cushioning element 110 to provide a continuous support surface along the bottom of the chassis 106.

The cushioning element 110 further includes an upper dock 160 disposed on the recessed surface 150. Generally, the upper dock 160 is configured to at least partially mate with the upper pocket 140 formed by the upper barrier layer 114 of the bladder 108. As shown, the upper dock 160 includes a plurality of upper ribs 162, extending from the lateral side 22 to the medial side 24 of the cushioning element 110 and arranged in series along a direction from the first end 142 to the second end 144 of the cushioning element 110. Each of the upper ribs 162 extends from the upper dock 160 to a distal end 164 facing away from the recessed surface 150. Here, the upper ribs 162 are configured to be received in the upper pockets 140 and between adjacent ones of the conduits 132 of the bladder 108. Accordingly, sides of the upper ribs 162 may be concave to receive corresponding convex portions of the conduits 132. As best shown in the cross-sectional view of FIG. 11, the upper ribs 162 may extend fully between the conduits 132, such that the distal ends 164 are in contact with the top side of the web area 120 when the sole structure 100 is assembled.

As described above, the cushioning element 110 is formed of a resilient polymeric material, such as foam or rubber, to impart properties of cushioning, responsiveness, and energy distribution to the foot of the wearer. Example resilient polymeric materials for the cushioning element 110 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

With continued reference to FIGS. 1-6, the cradle 112 is received within the recess 154 of the cushioning element 110, and cooperates with the cushioning element 110 and the outsole 104 to support the bladder 108. In the illustrated example, the cradle 112 includes a top plate 166, a first end support 170, and a second end support 172 that cooperate to define a receptacle 174 disposed beneath the top plate 166. The receptacle 174 is configured to receive the bladder 108 therein. When the sole structure 100 is assembled, the top plate 166 is received against the recessed surface 150 of the cushioning element 110. Like the cushioning element 110, the cradle 112 may include a resilient polymeric material, such as foam or rubber, to impart properties of cushioning, responsiveness, and energy distribution to the foot of the wearer. However, the material of the cradle 112 has a greater hardness and/or stiffness than the materials of the cushioning element 110 to provide the heel region 16 with a relatively rigid interface between the cushioning element 110 and the bladder 108. For example, the material of the cradle 112 may have a hardness of about 85 Shore A while the material of the cushioning element 110 includes a hardness ranging from 39 to 45 Shore C.

As shown, the top plate 166 extends from the first end support 170 to the second end support 172 and defines an upper portion of the receptacle 174. The top plate 166 includes a top surface 168*a* facing the recessed surface 150 of the cushioning element 110 and a bottom surface 168*b* formed on an opposite side from the top surface 168*a*. A distance from the top surface 168*a* to the bottom surface 168*b* defines a thickness of the top plate 166, which may be substantially constant along a direction from the first end support 170 to the second end support 172.

The bladder 108 may be configured to contact the cushioning element 110. In one aspect of such a configuration, the top plate 166 includes a pair of openings 176 formed through the thickness of the top plate 166. Each opening is configured to matingly receive a corresponding one of the upper ribs 162 of the upper dock 160 of the cushioning element 110, wherein the upper ribs 162 are placed into contact with the web area 120 of the bladder 108 disposed between the segments 132. As shown, the openings 176 are formed as independent openings 176 separated by a portion of the cradle 112. Thus, where the cradle 112 includes materials having a greater stiffness than the materials forming the cushioning element 110, the relatively stiff material of the cradle 112 functions as a brace to minimize deflection associated with bending and torsional forces at the base of each rib 162 while still allowing the softer material of the upper ribs 162 to compress along the height of each rib 162 (i.e., from the distal end 164 to the recessed surface 150).

The first end support 170 of the cradle 112 is disposed adjacent to and faces the end wall 156 of the recess 154, while the second end support 172 is disposed between the cushioning element 110 and the outsole 104 at the posterior end 20 of the sole structure 100. Each of the end supports 170, 172 extends from the top plate 166 to a respective distal end 178, 180 that faces and attaches to the outsole 104. As shown in FIGS. 5 and 6, the first end support 170 has a shape and cross-sectional profile configured to engage the end wall 156 of the support member 152 such that the first end support 170 cooperates or interfaces with end wall 156 to secure a position of the first end support 170 relative to the cushioning element 110. Optionally, the distal end 178 of the first end support 170 may include a lip 182 extending outwardly therefrom. The lip 182 is substantially planar and extends between the outsole 104 and the support member 152 when the sole structure 100 is assembled—further securing the first end support 170 to the cushioning element 110. Furthermore, the lip 182 may provide a spring element at the anterior end of the cradle 112 by providing a responsive biasing force at the distal end 178 when the first end support 170 is compressed.

Each end support 170, 172 includes an inner surface 184*a*, 184*b* defining opposite ends of the receptacle 174. Each inner surface 184*a*, 184*b* has a concave cross-sectional shape extending across a width of the receptacle 174 from the lateral side 22 to the medial side 24. The arcuate shape of each end support 170, 172 forms a resilient structure at each end of the cradle 112, which allows the end supports 170, 172 to compress. The end supports 170, 172 may have different radii to provide different spring rates at each end of the cradle 112.

As provided above, the top plate 166 and the end supports 170, 172 cooperate to define the receptacle 174 of the cradle 112 for receiving the bladder 108 therein. As shown, the respective edges of the plate 166 and the supports 170, 172 may cooperate to define a peripheral opening 186 into the receptacle 174 on opposite sides of the cradle 112. In other words, the receptacle 174 extends continuously through the cradle 112 from the lateral side 22 to the medial side 24. The receptacle 174 defines an active space within which the bladder 108 can compress and expand. As discussed in greater detail below, the bladder 108 provides the majority of the support and cushioning in the heel region.

With reference to FIGS. 5 and 6, the outsole 104 includes an inner surface 188*a* facing the midsole 102 and an exterior surface 188*b* defining a ground-engaging surface of the sole structure 100. The outsole 104 may include a lower dock 190 formed on the inner surface 188*a*, which is configured to receive a lower portion (e.g., the lower barrier layer 116) of the bladder 108 when the sole structure 100 is assembled. As shown in FIG. 5, a distal end surface of the lower dock 190 defines a recess 192 having a profile corresponding to the profile of the lower barrier layer 116 of the bladder 108. Accordingly, the recess 192 has a profile and arrangement corresponding to the shape (e.g., elongate with rounded ends) and arrangement (e.g., converging) of the conduits 132 and bodies 134 of the cushions 130. The recess 192 may define a pair of lower ribs 194 configured to oppose the upper ribs 162 of the upper dock 160. However, unlike the upper ribs 162, which extend fully between the conduits 132 and contact the top side of the web area 120, the lower ribs 194 may be spaced apart from the bottom side of the web area 120 formed by the lower barrier layer 116.

Figure 10:
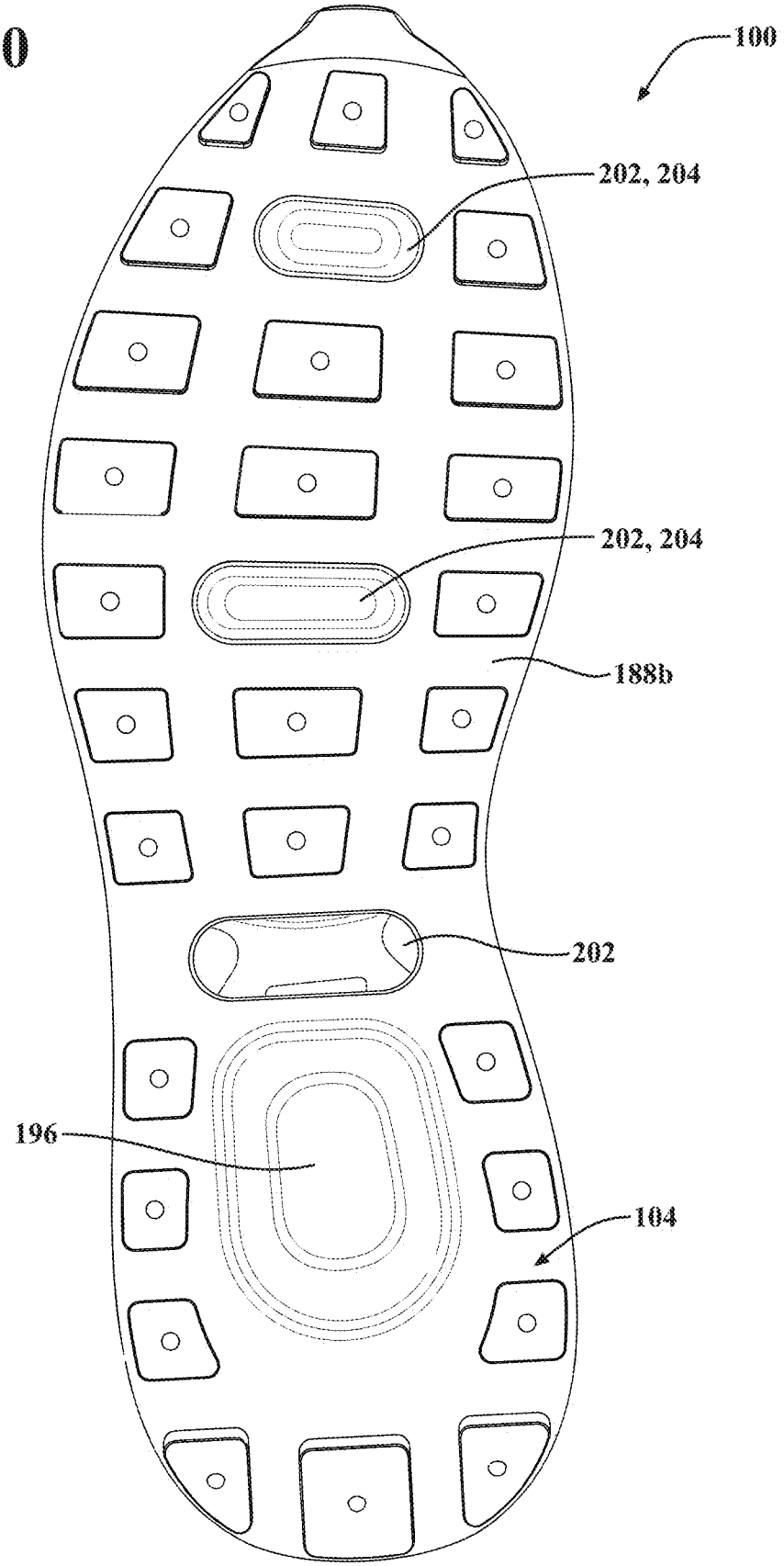
FIG. 10 is a bottom plan view of the sole structure of FIG. 1.
Figure 16:
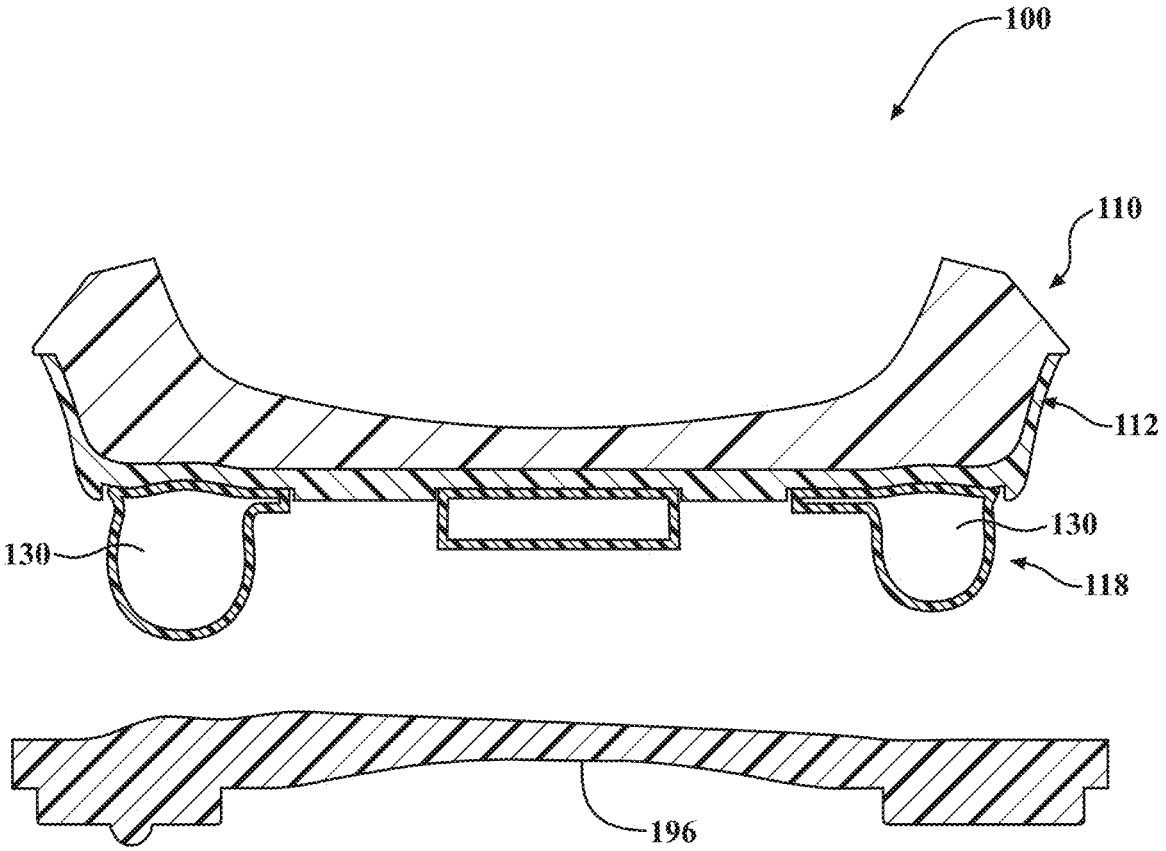
FIG. 16 is a cross-sectional view of the sole structure of FIG. 9, taken along Line 16-16.

With reference now to FIGS. 6, 10, and 16, the outsole 104 may include a depression 196 formed opposite the lower dock 190 in the exterior surface 188*b* of the outsole 104. Thus, the lower dock 190 is spaced apart from the ground surface by the depression 196 when the sole structure 100 is in an uncompressed state. In use, the web area 120 and the lower dock 190 may cooperate to provide a trampoline-like response in the heel region 16.

The outsole 104 further includes a lower support pad 198 configured to cooperate with the second end support 172 of the cradle 112 to support the posterior end 20 of the sole structure 100. As best shown in the cross-sectional view of FIG. 11, the lower support pad 198 extends from the inner surface 188*a* of the outsole 104 and defines a cavity configured to receive the distal end 180 of the second end support 172.

The outsole 104 may further include a plurality of apertures 202 formed through a thickness of the outsole from the inner surface 188*a* to the exterior surface 188. When included, the apertures 202 may expose corresponding reliefs 204 formed in the bottom surface 148 of the support member 152. The reliefs 204 are depressions formed in the bottom surface 148. In the illustrated example, the apertures 202 have an obround shape and the reliefs are generally ellipsoidal. The apertures 202 expose the ellipsoidal reliefs 204 in the bottom surface 148. The apertures 202 and the reliefs 204 cooperate to provide flexions along the forefoot region 12 and the mid-foot region 14.

Figure 2:
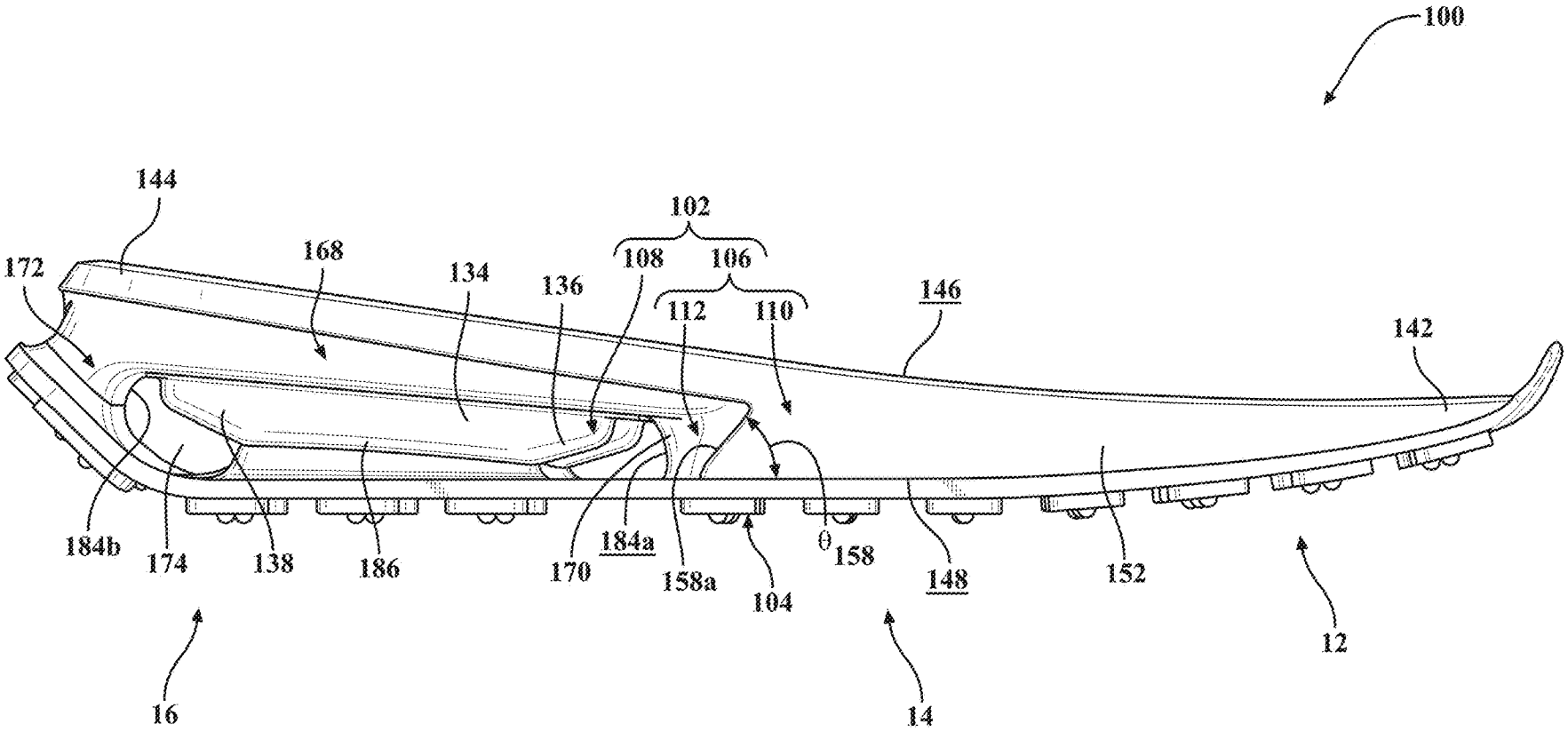
FIG. 2 is a perspective view of the sole structure shown in FIG. 1 taken from the medial side.
Figure 3:
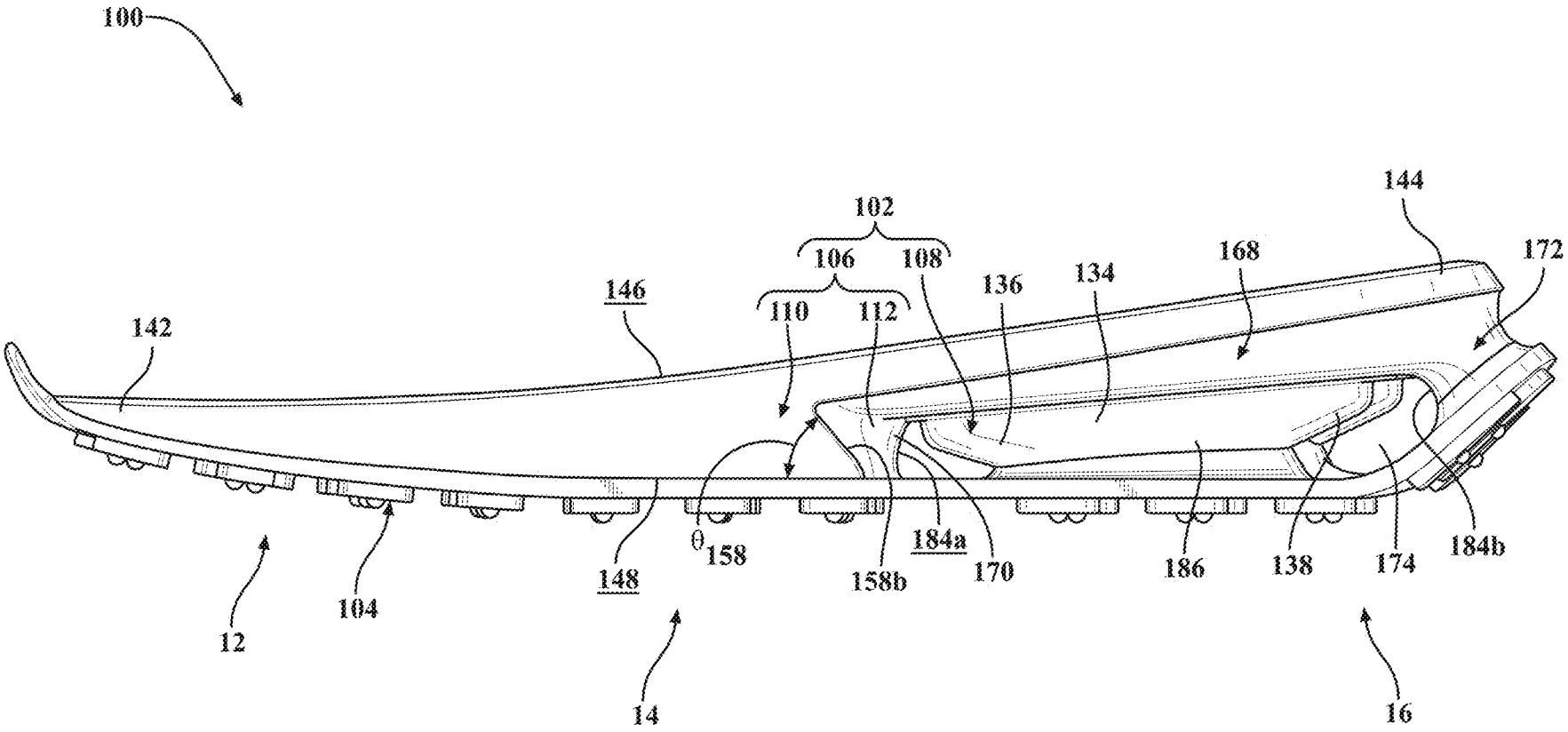
FIG. 3 is a perspective view of the sole structure shown in FIG. 2 taken from the medial side.

As set forth above, the components of the sole structure 100 cooperate to form a pressure-responsive shock-absorber in the heel region 16 of the sole structure 100. Here, the tubular bodies 134 of the cushions 130 of the bladder 108 are supported between the bottom surface 168*b* of the plate 166 and the interior surface 188*a* of the outsole 104, while the distal ends 136, 138 of the cushions 130 taper away from the interior surface 188*a* of the outsole 104. As best shown in FIGS. 2 and 3, the terminal ends 136, 138 of the cushions 130 are spaced apart from the end supports 170, 172 of the cradle 112. Thus, as the heel region 16 of the sole structure 100 is compressed, the tubular bodies 134 are compressed between the plate 166 and the outsole 104. The localized contact between the bladder 108, the plate 166, and the outsole 104 allows increased displacement of the fluid within the chamber 118 when the bladder 108 is compressed, as the distal ends 136, 138 of the cushions 130 are free to expand to accommodate the displaced fluid.

In addition to the relationship between the plate 166 and the cushions 130, the upper ribs 162 of the cushioning element 110 provide a resilient interface between the web area 120 of the bladder 108 and the cushioning element 110. By forming the upper ribs 162 using the softer material of the cushioning element 110, the upper ribs 162 are configured to absorb compressive forces applied by the web area 120 when the bladder 108 is compressed while still functioning to secure a position of the bladder 108 within the receptacle 174. As provided above, the end supports 170, 172 of the cradle 112 are arcuate in shape and, as such, are configured to bend or flex when the top plate 166 is compressed towards the outsole 104. Accordingly, the upper ribs 162 and the end supports 170, 172 provide supplementary support and cushioning to the bladder 108 in the heel region 16. In some examples, the end supports 170, 172 may be resilient structures that provide a responsive reaction to the foot after compression, similar to a spring.

While the chassis 106 and bladder 108 provide cushioning properties in the heel region 16, the support member 152 provides cushioning and support in the forefoot region 12. In some instances, the material of the cushioning element 110 may provide different performance characteristics than the chassis 106 and the bladder 108. For example, the support member 152 may provide localized, micro-level cushioning along the forefoot region 12 where the foot includes more joints, while the cradle 112 provides more general, macro-level cushioning at the heel region 16 where the calcaneus bone is located.

The upper 200 is attached to the sole structure 100 and forms an enclosure having plurality of components that cooperate to define an interior void 206 and an ankle opening 208, which cooperate to receive and secure a foot for support on the sole structure 100. The upper 200 may be formed from one or more materials that are stitched or adhesively bonded together to define the interior void 206. Suitable materials of the upper 200 may include, but are not limited to, textiles, foam, leather, and synthetic leather. The example upper 200 may be formed from a combination of one or more substantially inelastic or non-stretchable materials and one or more substantially elastic or stretchable materials disposed in different regions of the upper 200 to facilitate movement of the article of footwear 10 between the tightened state and the loosened state. The one or more clastic materials may include any combination of one or more clastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

The upper 200 includes a pair of quarter panels 210 in the mid-foot region 14 on opposite sides of the interior void 206. A throat 212 extends across the top of the upper 200 and defines an instep region extending between the quarter panels 210 from the ankle opening 208 to the forefoot region 12. In the illustrated example, the throat 212 is enclosed, whereby a material panel extends between the opposing quarter panels in the instep region to cover the interior void 206. Here, the material panel covering the throat 212 may be formed of a material having a higher modulus of elasticity than the material forming the quarter panels 210.

The upper 200 of the article of footwear 10 may be further described as including heel side panels 214 extending through the heel region 16 along the lateral and medial sides 22, 24 of the ankle opening 208. A heel counter 216 wraps around the posterior end 20 of the footwear 10 and connects the heel side panels 214. Uppermost edges of the throat 212, the heel side panels 214, and the heel counter 216 cooperate to form a collar 218, which defines the ankle opening 208 of the interior void 206.

The illustrated upper 200 includes a plurality of mid-foot tessellation panels 220. FIG. 1 illustrates a first one of the mid-foot tessellation panels 220 disposed on the lateral side 22 of the upper 200. However, the upper 200 may also include a mid-foot tessellation panel (not shown) on the medial side 24 having a mirrored geometry from the mid-foot tessellation panel 220 shown in FIG. 1. The mid-foot tessellation panel 220 has the shape of a parallelogram and includes a first end 222 facing the anterior end 18 and a parallel second end 224 facing the posterior end 20. The mid-foot tessellation panel 220 extends from a bottom edge 226 adjacent to the sole structure 100 at a bite-line (i.e., where the upper 200 and the sole structure 100 meet) and a top edge 228 adjacent to the throat 212. As shown, the second end 224 of the mid-foot tessellation panel 220 is parallel to the first end 158*a* of the end wall 156 such that the second end 224 and the first end 158*a* extend at the same oblique angle $\theta_{158}$ relative to the bottom surface 148. Optionally, the second end 224 of the mid-foot tessellation panel 220 may be collinear with the first end 158*a* of the end wall 156. Thus, the mid-foot tessellation panel 220 and the end wall 156 may cooperate to provide targeted flexibility in the article of footwear 10.

With continued reference to FIG. 1, the upper 200 may further include a heel tab 230 attached to the upper 200 at the posterior end 20. The heel tab 230 includes an elastic fabric material, such as a polymeric material, and is configured to function as a handle that can be grasped while donning the article of footwear 10 to pull the heel counter 216 over the heel of the foot. Optionally, the heel tab 230 may be configured as toe step that can be engaged by the opposing foot to assist in remove the upper 200 from the foot when doffing the article of footwear 10.

The following Clauses provide exemplary configurations for the article of footwear 10 and sole structure 100 described above.

Clause 1: A sole structure for an article of footwear, the sole structure comprising: a cushioning element including a first material; a cradle including a second material, attached to the cushioning element, and including a plate disposed against the cushioning element and a pair of supports extending from opposite ends of the plate; and a bladder disposed within the cradle between the pair of supports. An upper barrier layer of the bladder contacts the plate.

Clause 2: The sole structure of Clause 1, further comprising an outsole disposed adjacent to the plate on an opposite side of the cradle from the cushioning element.

Clause 3: The sole structure of Clause 2, wherein a lower barrier layer of the bladder contacts the outsole.

Clause 4: The sole structure of any of Clauses 2 or 3, wherein each of the pair of supports contacts the outsole.

Clause 5: The sole structure of any of Clauses 1-4, wherein the plate and the pair of supports partially define a receptacle extending continuously through the cradle from a first side to a second side.

Clause 6: The sole structure of Clause 5, wherein each of the pair of supports includes a concave surface facing the bladder.

Clause 7: The sole structure of Clause 6, wherein the concave surface of each of the pair of supports is spaced apart from the bladder.

Clause 8: The sole structure of any of Clauses 1-7, wherein the bladder contacts the cushioning element through the cradle.

Clause 9: The sole structure of Clause 1, wherein the cradle includes at least one opening.

Clause 10: The sole structure of Clause 9, wherein the cushioning element includes an upper dock engaging the bladder through an opening in the cradle.

Clause 11: The sole structure of Clause 10, wherein the upper dock includes a plurality of ribs, each of the plurality of ribs extending through a corresponding one of the at least one opening of the cradle to engage bladder.

Clause 12: The sole structure of any of Clauses 1-11, wherein the plate has a greater hardness than the cushioning element.

Clause 13: An article of footwear incorporating the sole structure of any of the preceding Clauses.

Clause 14: A sole structure for an article of footwear, the sole structure comprising: a cushioning element; a cradle received by the cushioning element and defining a receptacle extending continuously through the cradle from a first side of the sole structure to a second side of the sole structure; and a bladder disposed within the receptacle and contacting the cradle and a portion of the bladder contacting the cushioning element.

Clause 15: The sole structure of Clause 14, further comprising an outsole disposed on an opposite side of the cradle from the cushioning element.

Clause 16: The sole structure of Clause 15, wherein a lower barrier layer of the bladder contacts the outsole.

Clause 17: The sole structure of any of Clauses 14-16, wherein the cradle includes a plate contacting an upper barrier layer of the bladder.

Clause 18: The sole structure of Clause 17, wherein the cradle includes a first end support extending from the plate at a first end of the cradle and a second end support extending from the plate at a second end of the cradle.

Clause 19: The sole structure of any of Clauses 14-18, wherein the cushioning element includes an upper dock engaging the bladder through the cradle.

Clause 20: The sole structure of Clause 19, wherein the plate includes at least one opening formed therethrough and a portion of the cushioning element extends through the at least one opening so as to engage the bladder.

Clause 21: The sole structure of Clause 20, wherein the upper dock engages the bladder through the at least one opening of the cradle.

Clause 22: The sole structure of Clause 21, wherein the upper dock includes a plurality of ribs and the at least one opening is a plurality of openings, the plurality of ribs extending through a corresponding one of the plurality of openings in the cradle to engage bladder.

Clause 23: The sole structure of any of Clauses 14-22, wherein the cradle has a greater hardness than the cushioning element.

Clause 24: The sole structure of any of Clauses 14-22, wherein the cradle has a hardness of 85 Shore A and the cushioning element has a hardness of 39 to 45 Shore C.

Clause 25: An article of footwear incorporating the sole structure of any of the preceding Clauses.

Clause 26: An article of footwear comprising: a sole structure; and an upper attached to the sole structure and including at least one tessellation panel configured to define a tessellation zone along the upper.

Clause 27: The article of footwear of Clause 26, wherein the tessellation panel is aligned with a support member of the sole structure.

Clause 28: The article of footwear of Clause 27, wherein the tessellation panel includes a first edge aligned with an end of the support member of the sole structure in a mid-foot region.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a cushioning element including a first material and a first rib;

a cradle including a second material, attached to the cushioning element, and including a plate disposed against the cushioning element and a pair of supports including a first support extending downwardly from an anterior end of the plate and a second support extending from a posterior end of the plate, the plate including a first opening receiving the first rib;

a bladder disposed within the cradle between the pair of supports and including an upper barrier layer contacting the plate, the bladder including a first conduit, a second conduit, and a third conduit each extending transverse to a longitudinal axis of the sole structure and a web area extending between the first conduit and the second conduit, the first rib contacting the web area between the first conduit and the second conduit; and an outsole disposed on an opposite side of the bladder from the cushioning element, the outsole including a second rib opposing the first rib and spaced apart from the bladder to define a void between the second rib and the bladder.

2. The sole structure of claim 1, wherein the outsole is disposed adjacent to the plate on an opposite side of the cradle from the cushioning element.

3. The sole structure of claim 1, wherein a lower barrier layer of the bladder contacts the outsole.

4. The sole structure of claim 1, wherein each of the pair of supports contacts the outsole.

5. The sole structure of claim 1, wherein the plate and the pair of supports partially define a receptacle extending continuously through the cradle from a first side to a second side.

6. The sole structure of claim 5, wherein each of the pair of supports includes a concave surface facing the bladder.

7. The sole structure of claim 6, wherein the concave surface of each of the pair of supports is spaced apart from the bladder.

8. The sole structure of claim 1, wherein the first rib extends through the plate at the first opening.

9. An article of footwear incorporating the sole structure of claim 1.

10. A sole structure for an article of footwear, the sole structure comprising:

a cushioning element including a first material and a first rib;

a cradle including a second material, attached to the cushioning element, and including a plate disposed against the cushioning element;

a bladder disposed within the cradle and including an upper barrier layer contacting the plate and a lower barrier layer disposed on an opposite side of the bladder than the upper barrier layer; and an outsole including a ground-engaging surface and a second rib disposed on an opposite side of the outsole than the ground-engaging surface and extending in a direction away from the ground-engaging surface, the second rib opposing the first rib and spaced apart from the lower barrier layer of the bladder to define a void between a distal end of the second rib and the lower barrier layer.

11. The sole structure of claim 10, wherein the first rib extends through the plate and contacts the bladder.

12. The sole structure of claim 11, wherein the bladder includes a first conduit, a second conduit, and a web area extending between the first conduit and the second conduit, the first rib contacting the web area between the first conduit and the second conduit.

13. The sole structure of claim 12, wherein the second rib opposes and is spaced apart from the web area between the first conduit and the second conduit.

14. The sole structure of claim 12, wherein the first conduit and the second conduit are in contact with the outsole on the opposite side of the outsole than the ground-engaging surface.

15. The sole structure of claim 14, wherein the outsole includes a first recess receiving the first conduit and a second recess receiving the second conduit, the second rib extending between the first recess and the second recess.

16. The sole structure of claim 10, wherein the lower barrier layer of the bladder is in contact with the outsole on the opposite side of the outsole than the ground-engaging surface.

17. The sole structure of claim 10, wherein the first rib and the second rib are elongate.

18. An article of footwear incorporating the sole structure of claim 10.

* * * * *